US006224281B1

(12) United States Patent
Kim

(10) Patent No.: US 6,224,281 B1
(45) Date of Patent: May 1, 2001

(54) COSMETIC PENCIL CARTRIDGE HAVING A REPLACEABLE AUXILIARY HOLDER

(76) Inventor: Min-Soo Kim, 184-141, Hwaseo 1-dong, Jangan-gu, Kyunggi-do, 440-151 (KR)

( * ) Notice: Subject to any disclaimer, the term of this patent is extended or adjusted under 35 U.S.C. 154(b) by 0 days.

(21) Appl. No.: 09/303,571

(22) Filed: May 3, 1999

(30) Foreign Application Priority Data

Nov. 3, 1998 (KR) ..... 1998/24115
Dec. 28, 1998 (KR) ..... 1998/26764

(51) Int. Cl.[7] ..... A45D 40/04

(52) U.S. Cl. ..... 401/75; 132/318; 401/68; 401/78

(58) Field of Search ..... 401/75, 77, 78, 401/87, 88, 68; 132/318

(56) References Cited

U.S. PATENT DOCUMENTS 2,529,673 * 11/1950 Blake ..... 401/87 X
3,310,168 * 3/1967 Landen ..... 401/78 X
5,183,349 * 2/1993 Kamen ..... 401/68 X
5,553,956 * 9/1996 Mitsuya et al. ..... 401/68
5,609,430 * 3/1997 Mazzola et al. ..... 401/88 X
5,813,421 * 9/1998 Wang ..... 401/68 X

FOREIGN PATENT DOCUMENTS

867102 * 5/1961 (GB) ..... 401/88
883758 * 12/1961 (GB) ..... 401/88

* cited by examiner

*Primary Examiner*—Henry J. Recla
*Assistant Examiner*—Kathleen J. Prunner
(74) *Attorney, Agent, or Firm*—Birch, Stewart, Kolasch & Birch, LLP

(57) ABSTRACT

A cosmetic pencil cartridge is provided with a cap member having a guiding hole formed therethrough and a holder movably mounted into the cap member. In the cosmetic pencil cartridge, a stopping wall is formed within a mid portion of the cap member, an enlarged diameter portion being formed in front of the stopping wall, the holder having a pair of hook receiving holes formed through the leading portion of the holder. An auxiliary holder has a mass receiving portion for receiving a cosmetic mass at is one side, and a pair of hooks protruding from at the other side thereof, with the pair of hooks being resiliently engaged into the hook receiving holes, respectively.

6 Claims, 5 Drawing Sheets

COSMETIC PENCIL CARTRIDGE HAVING A REPLACEABLE AUXILIARY HOLDER

FIELD OF THE INVENTION

The present invention relates to a cosmetic pencil cartridge, and more particularly, to a cosmetic pencil cartridge capable of accommodating various cosmetic masses different in size by exchanging a holder for fixing the cosmetic mass; the cosmetic pencil is also provided with; an auxiliary lid capable of not only supporting a leading portion of the cosmetic mass but also molding the leading portion into a beautiful shape without an extra means for supporting and shaping the leading portion of the cosmetic mass when the cosmetic mass is introduced into the cosmetic pencil cartridge.

DESCRIPTION OF THE PRIOR ART

Generally speaking, lipstick, eyebrow pencil, etc. are known as cosmetic pencils. Cosmetic masses contained within the cosmetic pencil, especially lipstick, are manufactured in different shapes and sizes.

Conventionally, in order to manufacture various cosmetic pencils having cosmetic masses in different sizes, cosmetic pencils have been independently designed and manufactured which increases the manufacturing cost of the whole cosmetic pencil.

There is shown in FIG. 1 one example of conventional cosmetic pencils. As shown, a pencil housing 1 has a cartridge inserted therewithin which includes a cap 2, a tube member 3 and a holder 4.

The cap 2 has a guiding hole 5 longitudinally formed therethrough and a guiding groove 8 longitudinally formed on an external surface thereof. The tube member 3 is rotatably mounted around the cap 2 and has a thread 10 formed therein.

The holder 4 of a substantially tubular shape is assembled into the cap 2 in such a way that a protuberance 11 formed on an end of the holder 4 is engaged with the thread 10 of the tube member 3 through the guiding groove 8. A cosmetic mass 13 is inserted into and seated on an inside of the holder 4.

However, the conventional cosmetic pencil constructed in this manner has the shortcoming in that, if dimensions of the cosmetic mass are changed, all of the components of the cosmetic pencil have to be newly designed and arranged. That is, in order to manufacture a new cosmetic pencil having a cosmetic mass different in size from old cosmetic mass, many components have to be newly designed and arranged for the new cosmetic pencil, increasing manufacturing cost and consumer price. Further, in accordance with the conventional technique, since the cosmetic pencil finally produced has a diameter depending upon the diameter of the cosmetic mass, the cosmetic pencil does not have a good appearance.

FIG. 6 is a sectional view of a conventional cosmetic pencil, which shows how a cosmetic mass is introduce into the cosmetic pencil. In the illustrated prior art, a cosmetic mass 23 has to be introduced through a hole 25 formed on a rear end of a pencil case 21, being supported by a cover 24 closely contacted with a leading portion of a cap member 22. As a result, the cosmetic mass 23 is molded by the cover 24 into a same shape as that of the cover 24.

Since the prior art cosmetic pencil is constructed in this manner, it has a shortcoming in that it needs separate tools, i.e., the cover, for the introduction of the cosmetic mass into the cap member. Furthermore, the hole of the pencil case has to be covered with, for example, a sticker or the like, whereby the whole manufacturing process becomes more complicated.

On the other hand, in the well-known cartridge type cosmetic pencil, the cosmetic mass is introduced from a leading portion of the cartridge. However, manufacturing this type of cosmetic pencil not only requires modifications of the machining tools as well as a separate means for molding the leading portion of the cosmetic mass but also has a lot of limitations in the manufacturing process.

SUMMARY OF THE INVENTION

It is, therefore, a primary object of the present invention to provide a cosmetic pencil cartridge capable of accommodating various sizes of cosmetic masses by replacing only a holder for fixing the cosmetic mass, without necessitating modifications of other components of the cartridge, thereby lowering the manufacturing cost and allowing a unique size of the cosmetic pencil cartridge.

The above and other objects of the invention are accomplished by providing a cosmetic pencil cartridge provided with a cap member having a guiding hole formed therethrough and a holder movably mounted into the cap member, wherein a stopping wall is formed within a mid portion of the cap member, an enlarged diameter portion being formed in front of the stopping wall, the holder having a pair of hook receiving holes formed through the leading portion of the holder, an auxiliary holder having a mass receiving portion for receiving the cosmetic mass at is one side, and a pair of hooks protruding from the other side of the auxiliary holder, and the pair of hooks being resiliently engaged into the hook receiving holes, respectively.

In accordance with one aspect of the present invention, the cosmetic pencil cartridge is further characterized in that a plurality of protuberant surfaces, each of which has a rectangular shape are formed within the enlarged diameter portion of the cap member, near the stopping wall, and a plurality of sunken surfaces of rectangular shape on each of which a corresponding protuberant surface is seated are formed on the auxiliary holder to thereby allow the hook receiving holes of the holder and the pair of hooks of the auxiliary holder to be exactly guided and engaged with each other.

Accordingly, when a diameter of the cosmetic mass to be used is substantially similar or equal to that of the holder, the cosmetic mass is directly inserted into the holder, and, when the diameter of the cosmetic mass is smaller or larger than that of the holder, the auxiliary holder is additionally assembled with the holder. By this configuration, most components of the cosmetic pencil cartridge have a great level of compatibility between cosmetic masses of different diameter.

In accordance with another aspect of the present invention, the cosmetic pencil cartridge is further characterized in that the cosmetic pencil cartridge has an auxiliary lid having a contact surface at its inner bottom and being combined with the leading portion of the cap member.

The inventive auxiliary lid having a contact surface and covering the leading portion of the cap member enables the cosmetic mass to be introduced from the rear end of the holder, so that the leading portion of the cosmetic mass is made in a same beautiful shape as that of the contact surface by being closely contacted on the contact surface of the auxiliary lid, when the cosmetic mass is fixed to the holder. Then the final packing process can be performed right after the introduction of the cosmetic mass, preventing the cosmetic pencil cartridge from being contaminated with alien material.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

A preferred embodiment of the inventive cosmetic pencil cartridge is now described with reference to accompanying drawings.

Figure 1:
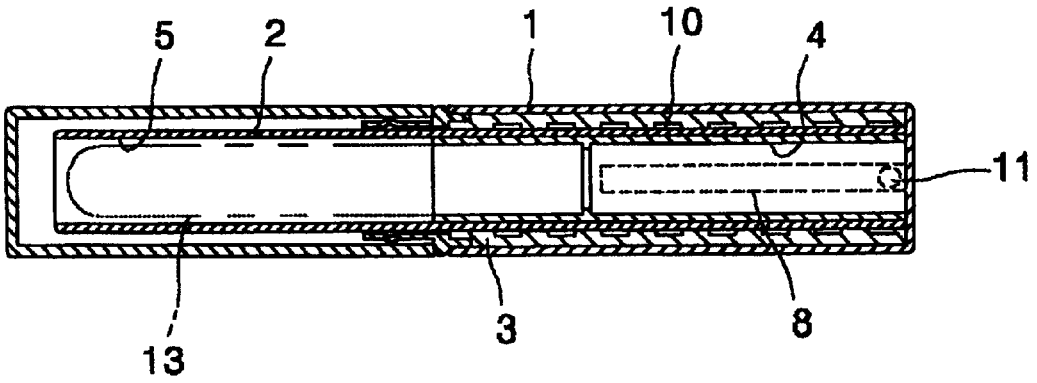
FIG. 1 (PRIOR ART)
FIG. 1 illustrates a sectional view of a prior art cosmetic pencil.
Figure 2:
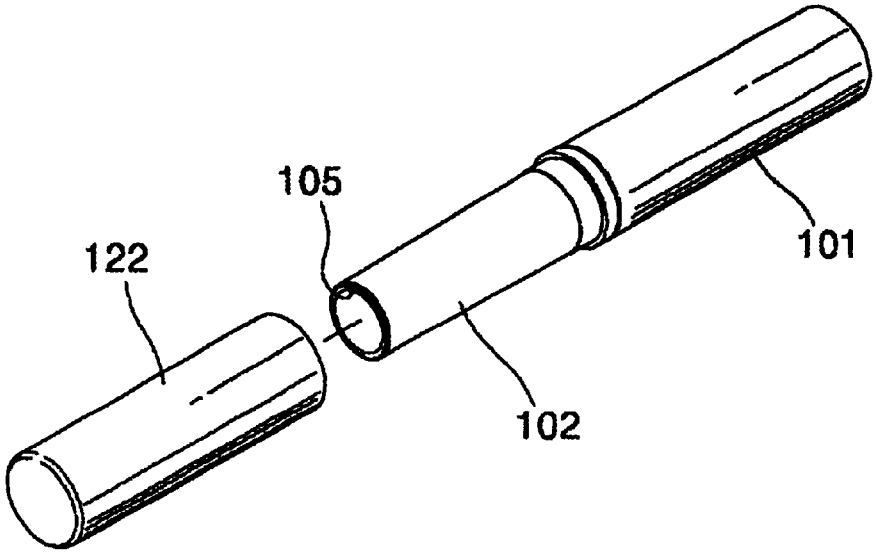
FIG. 2 offers a perspective view of an inventive cosmetic pencil cartridge.
Figure 3:
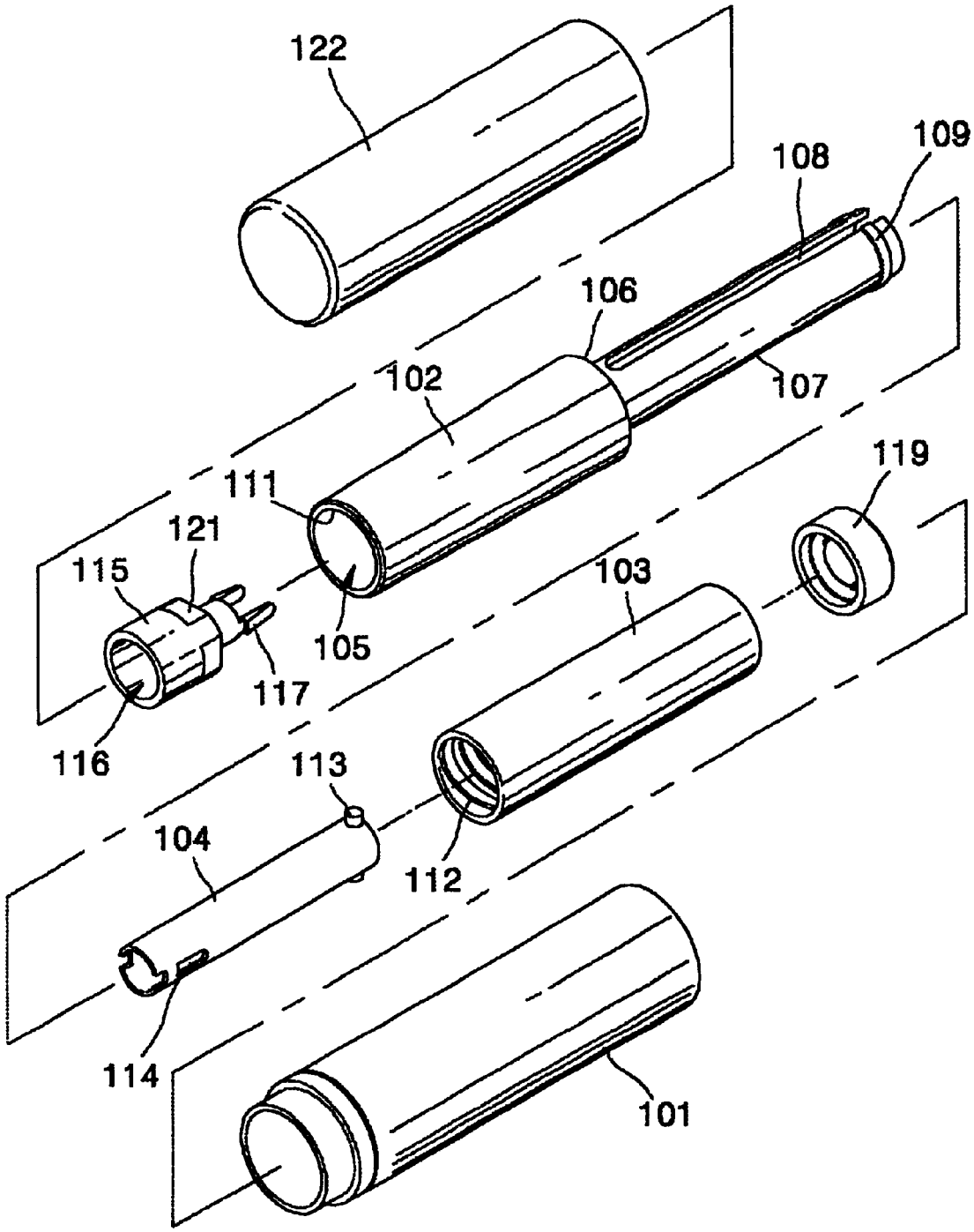
FIG. 3 depicts an exploded perspective view of the inventive cosmetic pencil cartridge in accordance with one embodiment.
Figure 4:
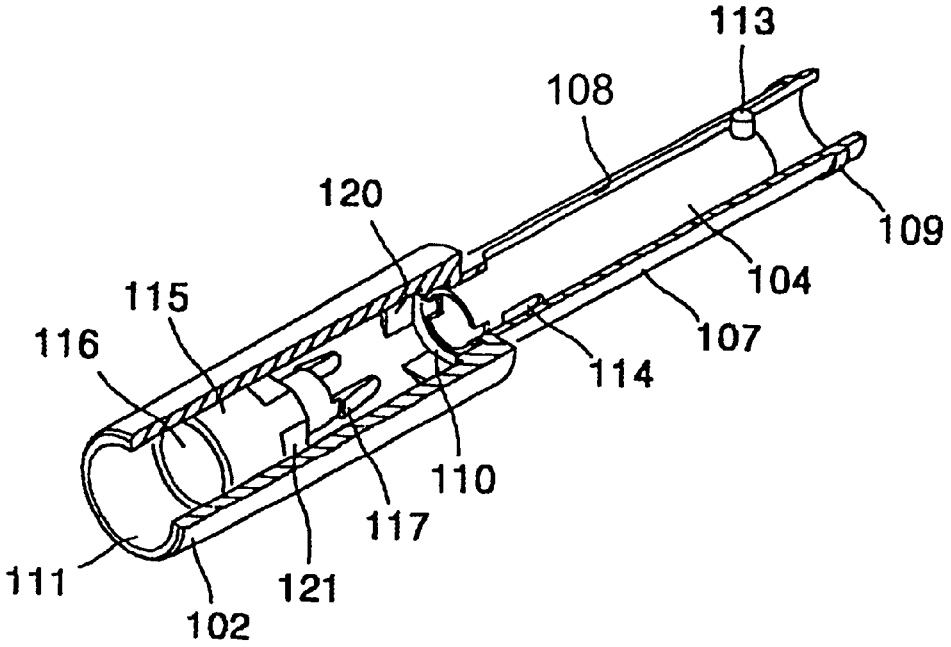
FIG. 4 shows a partially cut-away perspective view of a cap member of the inventive cosmetic pencil cartridge.
Figure 5:
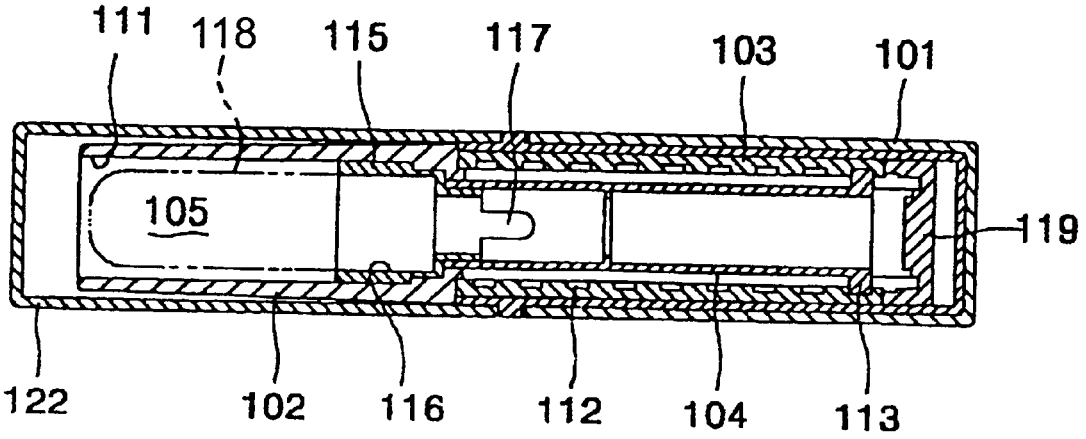
FIG. 5 presents a sectional view of the inventive cosmetic pencil cartridge.
Figure 6:
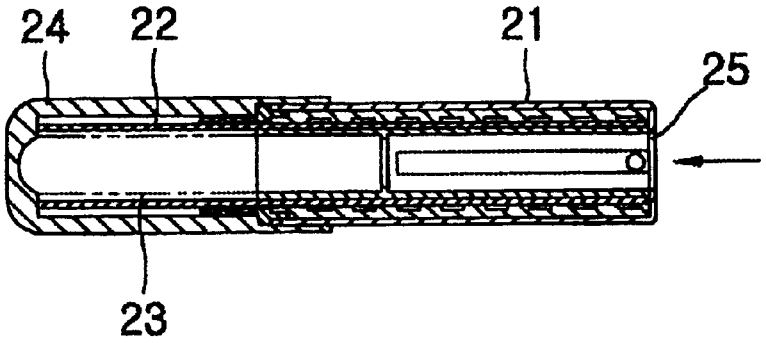
FIG. 6 (PRIOR ART)
FIG. 6 is a sectional view of a conventional cosmetic pencil, which shows how a cosmetic mass is positioned within the cosmetic pencil.

FIG. 2 offers a perspective view of an inventive cosmetic pencil cartridge; FIG. 3 depicts an exploded perspective view of the inventive cosmetic pencil cartridge in accordance with one embodiment; FIG. 4 shows a partially cut-away perspective view of a cap member of the inventive cosmetic pencil cartridge; and FIG. 5 presents a sectional view of the inventive cosmetic pencil cartridge.

Referring to FIGS. 2 through 5, the inventive cosmetic pencil cartridge is largely divided into a cap member 102, a tube member 103 and a holder 104 and may be used, being combined within a pencil housing 101 or not.

Referring to FIG. 3, the cap member 102 has a guiding hole 105 formed therethrough, a stepped portion 106 formed on a mid portion thereof and a connecting portion 107 rearwardly extending from the stepped portion 106. The connecting portion 107 includes one or two open slots 108 arranged lengthwise and a lateral protuberance 109 formed near an end of the connecting portion 107.

The open slot 108 opens at the end of the connecting portion 107, providing the connecting portion 107 with resilience; and the connecting portion 107 rearwardly extends beyond the protuberance 109.

Referring to FIG. 4, a stopping wall 110 is formed within the guiding hole 105, near the stepped portion 106; and an enlarged diameter portion 111 is formed in front of the stopping wall 110.

Returning to FIG. 3, the connecting portion 107 of the cap member 102 is assembled into the tube member 103 of a sleeve shape. A thread 112 is formed inside the tube member 103. The tube member 103 is rotatably mounted around the connecting portion 107. Once the tube member 103 is mounted on the connecting portion 107, the protuberance 109 of the connecting portion 107 prevents the tube member 103 from deviating from the mounted place.

The holder 104 is positioned within the cap member 102. The holder 104 of a substantially tubular shape has a pair of engaging posts 113 which engage within the thread 112 of the tube member 103 through the open slot 108, and a pair of opposing hook receiving holes 114 through which an auxiliary holder 115 is combined to the holder 104.

The auxiliary holder 115 has a diameter different from that of the holder 104. A mass receiving portion 116 is formed with a front portion of the auxiliary holder 115. A rear portion of the auxiliary holder 115 is sized to be insertable into the holder 104. A pair of hooks 117 protrude from the rear portion of the auxiliary holder 115 and are resiliently engaged into the hook receiving holes 114, respectively, to fix the auxiliary holder 115 to the holder 104.

According to the present invention, a bar-shaped cosmetic or cosmetic mass 118 is fixed by the holder 104 or the auxiliary holder 115. When the diameter of the cosmetic mass 118 to be used in the inventive cosmetic pencil cartridge is substantially similar or equal to that of the holder 104, the cosmetic mass 118 is directly inserted into the holder 104. However, when the diameter of the cosmetic mass 118 is smaller or larger than that of the holder 104, the auxiliary holder 115 provided with the mass receiving portion 116 whose diameter fits around the cosmetic mass 118 is additionally assembled with the holder 104. By this configuration, most components of the inventive cosmetic pencil cartridge have a great level of compatibility with cosmetic masses having different diameters.

A rear cover 119 fits around the end of the connecting portion 107. It is preferable that the rear cover 119 indicates a color of the cosmetic mass 118 for consumer convenience.

On the other hand, since the holder 104 and the auxiliary holder 115 are inserted into the cap member 102 in opposite directions to each other about the cap member 102 during an assembling process, the two components must be properly guided within the cap member 102 to meet with each other. For this, a plurality of protuberant surfaces 120 each of which has a rectangular shape are formed within the enlarged diameter portion 111 of the cap member 102, near the stopping wall 110; and a plurality of sunken surfaces 121 each of which has a rectangular shape and corresponds to one of the protuberant surfaces 120 are formed on the auxiliary holder 115.

By this configuration, the holder 104 and the auxiliary holder 115 can be exactly combined to each other. That is, engagement between the sunken surface 121 and the protuberant surface 120 allows the auxiliary holder 115 to be arranged at an angle proper to meet the holder 104; and the holder 104 is arranged at a proper angle by its engaging posts 113 being retained within the open slot 108.

It can be seen that the shape of the sunken surfaces and the protuberant surfaces may be a hexagonal shape or a triangular shape in stead of the rectangular shape. Further, it can be seen that since the auxiliary holder 115 and the holder 104 are connected to each other, the cosmetic mass 118 can be introduced from a rear end of the holder 104 to be fixed or attached therein in the manufacturing process.

Operations of the inventive cosmetic pencil cartridge is described hereinbelow.

To allow the cosmetic mass 118 to be drawn out from the cap member 102, the tube member 103 is rotated in one direction with respect to the cap member 102. During the rotation of the tube member 103, the holder 104 is moved toward and along with the auxiliary holder 115, since the engaging posts 113 thereof are engaged with the thread 112 of the tube member 103, with its rotational movement being hindered by the open slot 108. When the tube member 103 is rotated in an opposite direction, the cosmetic mass 118 retracts toward and along with the holder 104.

As one feature of the present invention, a cross-section of the cosmetic mass 118 can be manufactured in various types, e.g., a rectangular shape or a hexagonal shape or an oval or the like, since the cosmetic mass 118 is shifted without any rotational movement.

Although the inventive cosmetic pencil cartridge may be serviced in a non-housing form, it is preferable that it be serviced in a form of being fitted within a pencil housing 101. In this case, when the pencil housing 101 is rotated with respect to the cap member 102, the tube member 103 is rotated to shift the cosmetic mass 118, since the pencil housing 101 and the tube member 103 have a press-fit relationship therebetween. Further, a lid 122 may be combined with the pencil housing 101, thereby protecting the cosmetic pencil cartridge.

According to the present invention, a cost required to get a new cosmetic pencil may be reduced by replacing the cosmetic pencil cartridge with the new one, after completion of the service life of the cosmetic mass 118. In this situation, if desired, the consumer may purchase a cosmetic pencil cartridge which has the same dimensions as those of the old cartridge but has a cosmetic mass different in diameter from that of the old one.

Figure 7:
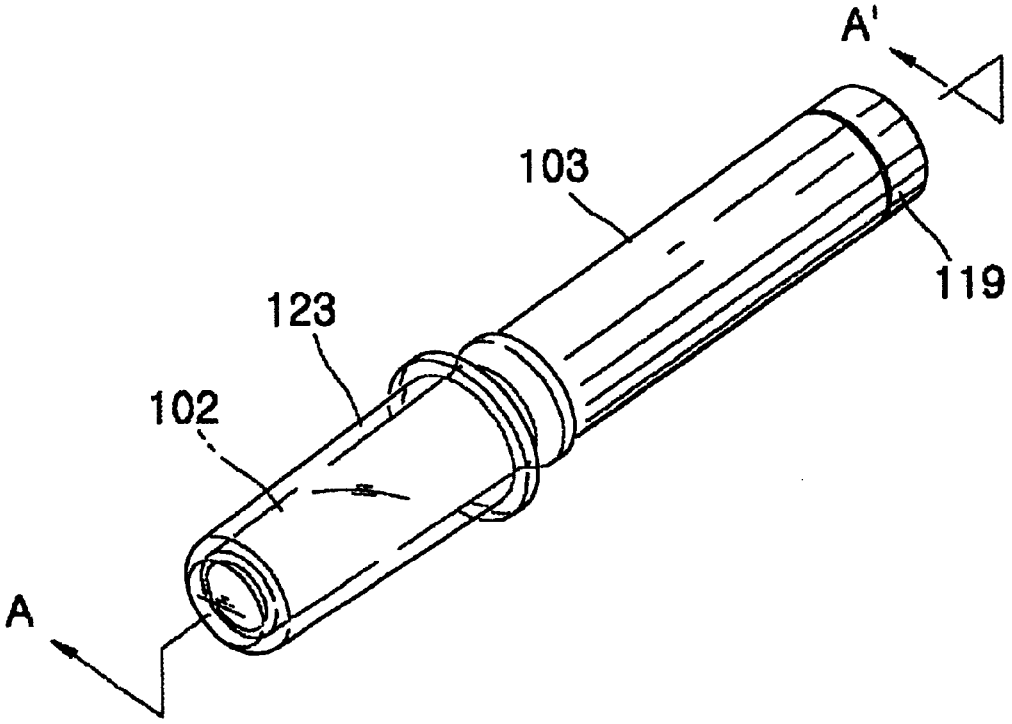
FIG. 7 gives a perspective view of the cosmetic pencil cartridge in accordance with a modification of the present invention.
Figure 8:
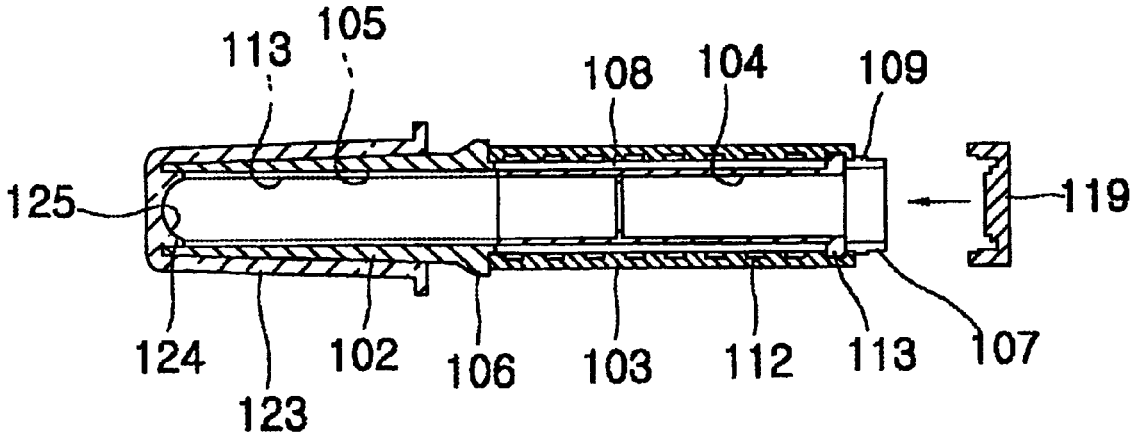
FIG. 8 represents a sectional view of the inventive cosmetic pencil cartridge shown in FIG. 7, when taken along a line A–A'.

On the other hand, FIG. 7 gives a perspective view of the cosmetic pencil cartridge in accordance with a modification of the present invention; and FIG. 8 represents a sectional view of the inventive cosmetic pencil cartridge shown in FIG. 7, when taken along a line A–A'.

Referring to FIGS. 7 and 8, a leading portion of the cap member 102 is covered with an auxiliary lid 123 which includes a protruding portion 124 formed on an internal bottom thereof and a contact surface 125 defined by the protruding portion 124.

In this modification, the cosmetic mass 118 is introduced from the rear end of the cap member 102 to be anchored at the holder 104(or the auxiliary holder, if it is), with its leading portion being closely contacted on the contact surface 125 of the auxiliary lid 123 to be made in a same shape as that of the contact surface 125.

After the introduction of the cosmetic mass 118, the rear cover 119 is finally combined with the rear end of the connecting portion 107. It is preferable that the rear cover 119 indicate a color of the cosmetic mass 118, allowing a consumer to easily find out the cosmetic pencil he wants by the color of the rear cover 119.

The cosmetic pencil cartridge with the auxiliary lid 123 may be directly packed as a finished product. The consumer may use the product by applying the pencil housing 101 thereon after he removes the auxiliary lid 123 from the cosmetic pencil cartridge. Otherwise he may use the product without removing the auxiliary lid 123. Accordingly, the present invention is able to prevent the cosmetic pencil cartridge from being contaminated with alien material.

It is preferable that the auxiliary lid 123 be made of a transparent material. It can be seen that the shape of the contact surface 125 may be made in various shapes, e.g., a semi-sphere or a polygon, etc.

The inventive auxiliary lid constructed in this manner has an applicability not only to the inventive cosmetic pencil cartridge shown in FIG. 7 but also to the prior art cosmetic pencil cartridges.

As described above, the present invention has several advantages. First, manufacture of a variety of cosmetic pencils having different cosmetic masses from one another is obtained by simply exchanging the auxiliary holder 115. That is, the manufacturer can produce new cosmetic pencil having cosmetic mass different from the old model without newly designing or developing components for the new cosmetic pencil. When one of the cosmetic masses different in size is applicable to one cosmetic pencil cartridge, unique size of the cosmetic pencils can be obtained. Further, the consumer can use various cosmetic masses different in size with the pencil housing of his or her own by only exchanging the cosmetic pencil cartridge.

Further, the inventive auxiliary lid 123 having a contact surface 125 at an inside of its bottom and covering the leading portion of the cap member 102 enables the cosmetic mass to be introduced from the rear end of the holder, so that the leading portion of the cosmetic mass is made in a same beautiful shape as that of the contact surface 125 by being closely contacted on the contact surface 125 of the auxiliary lid 123, when the cosmetic mass is fixed to the holder. That is, the inventive auxiliary lid 123 enables the introduction of the cosmetic mass without any separate tools or instruments to help it. Moreover, by the inventive auxiliary lid 123, final packing process can be performed right after the introduction of the cosmetic mass. Furthermore, the inventive auxiliary lid 123 prevents the cosmetic pencil cartridge from being contaminated with alien material.

Although the invention has been shown and described with respect to the preferred embodiments, it will be understood by those skilled in the art that various changes and modifications may be made without departing from the spirit and scope of the invention as defined in the following claims.

What is claimed is:

1. A cosmetic pencil cartridge comprising a cap member having a guiding hole formed therethrough, said cap member being provided with a stopping wall formed along the mid portion of the cap member and defining an enlarged diameter portion in front of the stopping wall;

a holder having hook receiving holes formed in a leading portion thereof and movably mounted in the cap member, wherein the leading portion of the holder is configured to allow an auxiliary holder having a diameter different from the diameter of the holder, to be engaged therewith to thereby enable a selective introduction of cosmetic masses having different diameters from one another into a single cosmetic pencil cartridge, said auxiliary holder having a mass receiving portion at one side for receiving the cosmetic mass and hook protruding members extending from the other side thereof, said hook protruding members being resiliently engaged in said hook receiving holes.

2. The cosmetic pencil cartridge of claim 1 wherein a plurality of protuberant surfaces are formed within the enlarged diameter portion of the cap member, near the stopping wall, and a plurality of sunken surfaces having dimensions corresponding to said protuberant surfaces are formed on the auxiliary holder to allow the hook receiving holes of the holder and the hook members of the auxiliary holder to be exactly guided and engaged with each other.

3. The cosmetic pencil cartridge of claim 1, wherein the cosmetic pencil cartridge has an auxiliary lid having a contact surface at its inner bottom and being combined with the leading portion of the cap member.

4. The cosmetic pencil cartridge of claim 1, wherein the cosmetic pencil cartridge has a rear cover for covering a rear end of the cap member.

5. The cosmetic pencil cartridge of claim 4, wherein the rear cover indicates a color of the cosmetic mass.

6. The cosmetic pencil cartridge of claim 1, wherein a tube member having a thread formed on the inside thereof is assembled on a rear external surface of the cap member, and an auxiliary lid is provided having a contact surface at its inner bottom and is combined with the leading portion of the cap member.

* * * * *

UNITED STATES PATENT AND TRADEMARK OFFICE

CERTIFICATE OF CORRECTION

PATENT NO. : 6,224,281 B1
DATED : June 12, 2001
INVENTOR(S) : Tadayasu Ohsawa; Hiromitsu Kurauchi It is certified that error appears in the above-identified patent and that said Letters Patent is hereby corrected as shown below:

Column 4,
Line 65, delete "the".

Column 7,
Line 36, insert -- , -- after "made" and "example".

Column 8,
Line 4, insert a space after "19c".

Column 9,
Line 44, insert a space after "2a".

Column 12,
Line 48, after "much" insert -- more --.

Signed and Sealed this

Eighteenth Day of December, 2001

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,224,281 B1
DATED : May 1, 2001
INVENTOR(S) : Min-Soo Kim

It is certified that error appears in the above-identified patent and that said Letters Patent is hereby corrected as shown below:

This certificate supersedes Certificate of Correction issued December 18, 2001, the number was erroneously mentioned and should be vacated since no Certificate of Correction was granted.

Signed and Sealed this

Fifteenth Day of April, 2003

JAMES E. ROGAN
*Director of the United States Patent and Trademark Office*